US010086248B2

(12) United States Patent
Nallamothu

(10) Patent No.: US 10,086,248 B2
(45) Date of Patent: Oct. 2, 2018

(54) BASKETBALL TRAINING DEVICE

(71) Applicant: HighGlasser LLC, Clarkston, MI (US)

(72) Inventor: Shivajee Nallamothu, Clarkston, MI (US)

(73) Assignee: HIGHGLASSER, LLC, Clarkston, MI (US)

( * ) Notice: Subject to any disclaimer, the term of this patent is extended or adjusted under 35 U.S.C. 154(b) by 22 days.

(21) Appl. No.: 15/613,383

(22) Filed: Jun. 5, 2017

(65) Prior Publication Data

US 2017/0354856 A1 Dec. 14, 2017

Related U.S. Application Data

(60) Provisional application No. 62/349,496, filed on Jun. 13, 2016.

(51) Int. Cl.

| | |
|---|---|
| ***A63B 69/08*** | (2006.01) |
| ***A63B 69/00*** | (2006.01) |
| ***A63B 63/08*** | (2006.01) |

(52) U.S. Cl.

CPC ..... *A63B 69/0071* (2013.01); *A63B 63/083* (2013.01)

(58) Field of Classification Search

CPC ..... A63B 69/0071; A63B 63/083
USPC ..... 473/433, 438, 447, 448, 485
See application file for complete search history.

(56) References Cited

U.S. PATENT DOCUMENTS

| | | | | |
|---|---|---|---|---|
| 5,823,590 | A * | 10/1998 | Forrest | B25J 1/04 294/104 |
| 6,595,879 | B1 * | 7/2003 | Robbins | A63B 63/083 473/422 |
| 6,739,637 | B2 * | 5/2004 | Hsu | B25G 3/18 294/115 |
| 7,090,598 | B2 * | 8/2006 | Elliot | A63B 63/083 473/447 |
| 7,402,116 | B2 * | 7/2008 | Zuccarini | A63B 69/0071 473/485 |
| 8,061,751 | B2 * | 11/2011 | Hatcher | B25G 1/04 294/115 |
| 2004/0242350 | A1 * | 12/2004 | Elliott | A63B 63/083 473/447 |
| 2009/0203472 | A1 * | 8/2009 | Snyder | A63B 63/083 473/433 |
| 2012/0202624 | A1 * | 8/2012 | Davis | A63B 63/08 473/485 |

* cited by examiner

*Primary Examiner* — Nini Legesse
(74) *Attorney, Agent, or Firm* — Reising Ethington, P.C.; Shannon Smith

(57) ABSTRACT

A basketball training device for mounting on a basketball hoop. The basketball training device includes a blocking body that is dimensioned so as to block shot attempts that are at an undesirable shooting angle or will result in an undesirable bank angle. The basketball training device may be a part of a kit which includes a placement apparatus that can be used to grab and place the basketball training device onto the rim of a basketball hoop.

13 Claims, 6 Drawing Sheets

BASKETBALL TRAINING DEVICE

REFERENCE TO RELATED APPLICATIONS

This application claims the benefit of U.S. Provisional Application Ser. No. 62/349,496 filed on Jun. 13, 2016, the entire contents of which are incorporated herein.

FIELD

The present disclosure generally relates to basketball training devices, and more particularly, to basketball training devices for mounting onto a basketball hoop to assist with shooting layups.

BACKGROUND

Basketball training drills oftentimes include layup drills. There are different types of layups, including half-court layups, full-court layups, and reverse layups, to cite a few examples. Layups are a type of inside shot that are quite common given that they are a high percentage shot when undefended. However, even when they are undefended, the layup can be difficult for some players because the shooting angle of the shot is often miscalculated. If the shooting angle is miscalculated, the ball may not elevate enough to get over the rim and subsequently bounce off of the bottom of the rim or backboard. Some players have figured out by practice that the shot has a better chance of being successful if they shoot higher and aim for the top of the shooter's square on the backboard, which usually correlates with a larger shooting angle. Additionally, miscalculation errors can occur when the player leaves the ground too late and ends up below the backboard, which makes the shot even more difficult to make. One way in which to address these miscalculation errors involves shooting the ball higher than the player would typically expect, but doing so at a shooting angle that will allow the ball to drop in the basket. This shot can help to avoid a defensive player from blocking the shot while also avoiding the ball undesirably hitting the bottom of the rim or the backboard.

SUMMARY

According to one embodiment, there is provided a basketball training device for mounting onto a basketball hoop having a rim and a backboard. The basketball training device comprises a blocking body and a basketball hoop attachment mechanism coupled to the blocking body. The basketball hoop attachment mechanism is configured to mount the blocking body on the rim or the backboard of the basketball hoop.

According to another embodiment, there is provided a basketball training device for mounting onto a basketball hoop having a rim and a backboard. The basketball training device comprises a plurality of blocking bodies, each blocking body including an attachment area and a projecting end, wherein a first blocking body is configured to be located on one side of the rim and a second blocking body is configured to be located on the other side of the rim, wherein the attachment area of the first blocking body faces the attachment area of the second blocking body and the projecting end of the first blocking body opposes the projecting end of the second blocking body.

DRAWINGS

Preferred exemplary embodiments of the invention will hereinafter be described in conjunction with the appended drawings, wherein like designations denote like elements, and wherein.

Figure 7:
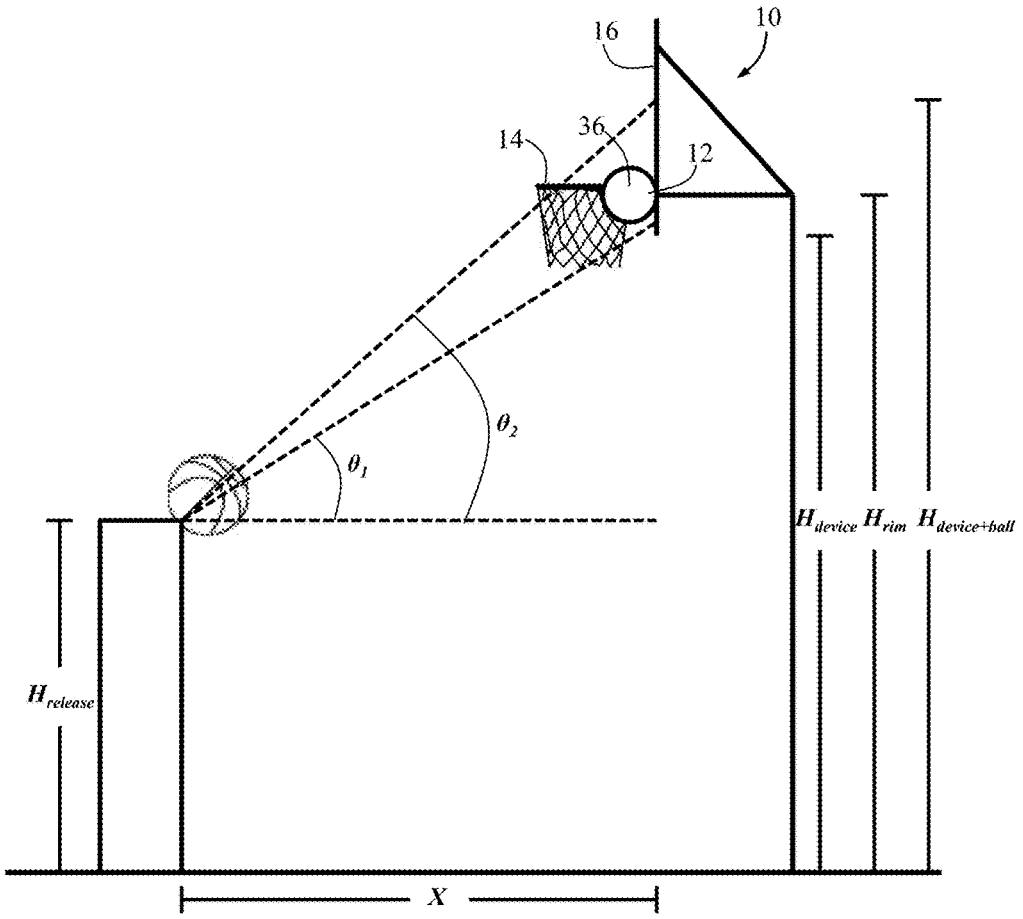
Figure 8:
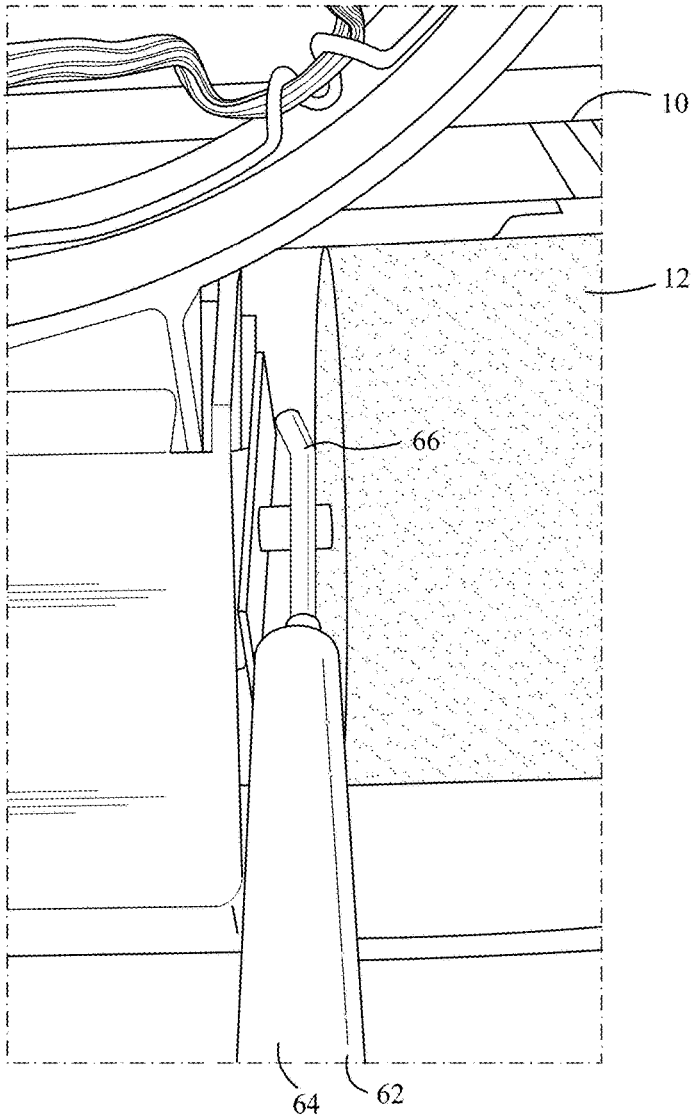
Figure 9:
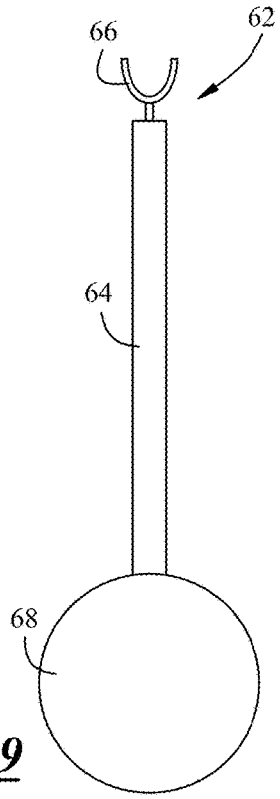

FIG. 7 schematically represents simplified shooting angles that may be blocked by one embodiment of the basketball training device;

FIG. 8 shows one embodiment of a placement apparatus which may be used for grabbing and placing the basketball training device; and FIG. 9 illustrates another embodiment of a placement apparatus.

DESCRIPTION

The basketball training device shown and described herein can help players improve their shooting accuracy, with layup shots in particular. The basketball training device can block shots that are not started early enough or shot too low against the backboard. Accordingly, the basketball training device can encourage an earlier shot (e.g., when the player leaves the ground close to the block), which can allow for a higher trajectory to the top corner of the shooter's square on the backboard. This higher trajectory can allow for a better shooting angle, thereby resulting in a more accurate shot. The basketball training device can help new players to the game, as well as experienced players trying to improve their skills with new or more challenging types of shots.

Figure 1:
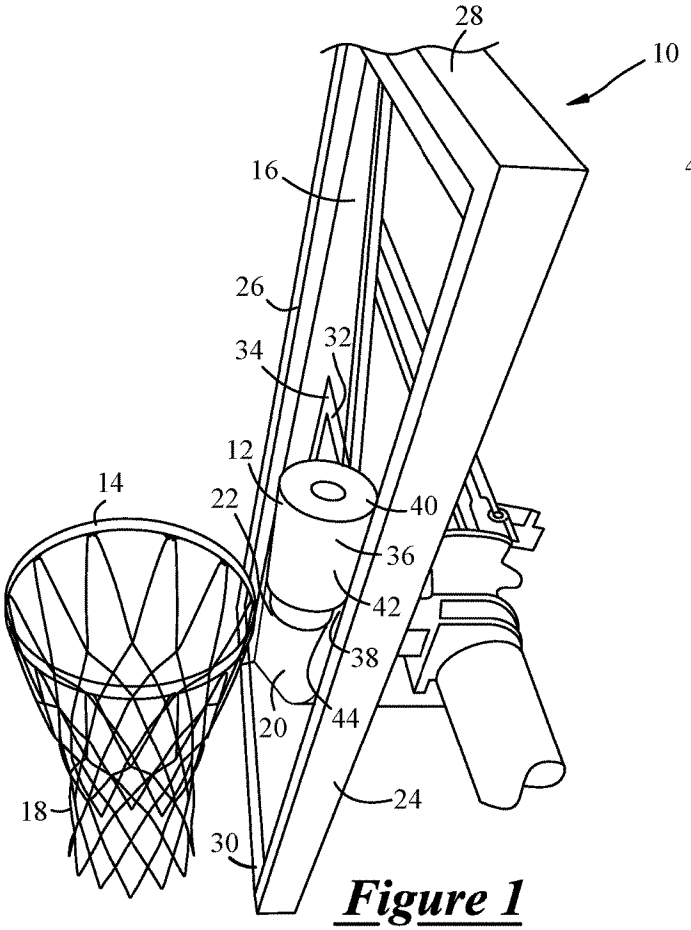
FIG. 1 shows a basketball hoop including a basketball training device in accordance with one embodiment.

Turning now to FIG. 1, there is shown a basketball hoop 10 with a basketball training device 12 in accordance with one embodiment. The basketball training device 12 may be used with any type or style of basketball hoop, and the illustrated basketball hoop 10 is only one example. The basketball hoop 10 includes a rim 14 and a backboard 16. The rim 14 may have optional components such as a net 18 and/or a rim support 20. The rim support 20 typically includes a spring (not shown) and a triangular metal sidewall 22. Another triangular metal sidewall (not shown) may be positioned so as to oppose the other triangular metal sidewall 22, with each sidewall helping to support the rim 14 against the backboard 16.

The backboard 16 of the basketball hoop 10 can include a bottom edge 24, a top edge 26, and side edges 28, 30. Other configurations for the backboard 16 are certainly possible, however. The backboard 16, in some embodiments, may include a shooter's square 32. The shooter's square 32 is typically a rectangle that is centered behind the rim 14 with 2 inch wide edges measuring about 24 inches along the top and bottom edges and 18 inches along the side edges. The shooter's square 32 can help to indicate to players optimal bank locations for particular shots, and may be particularly advantageous for layups. For example, it is preferable to aim for the top corner 34 of the shooter's square 32 for layup shots. Shots that bank near or above the top corner 34 typically have a better chance of going in as compared with similar trajectory shots that bank below the top corner 34 or closer to the bottom edge 24 of the backboard 16.

The basketball training device 12 is mounted on the basketball hoop 10 to help promote better shooting angles and banking locations for layup shots. The basketball training device includes a blocking body 36. In this embodiment, the blocking body 36 includes an attachment area 38 which may be situated toward the rim 14 and a projecting end 40 which typically extends away from the rim 14 toward the side edge 28 of the backboard 16. The blocking body 36 serves to block shots that are shot at an undesirable shooting angle or released too late so as to have a slight bank angle, which can also be undesirable. In the illustrated embodiment, the blocking body 36 is made from a foam material, which may be an open-cell foam or a closed-cell foam; however, any operable material may be used for the blocking body. In at least some implementations, a resilient material may be desirable since the blocking body may incur numerous impacts from one or more basketballs.

In the illustrated embodiments, the blocking body 36 is a cylindrical shape. While a cylindrically shaped blocking body 36 is preferred in some embodiments, other shaped blocking bodies are certainly possible, such as elliptical shaped blocking bodies or polygonal shaped blocking bodies. The blocking body 36 may be tapered or chamfered in certain locations, depending upon the particular implementation. The blocking body 36 may be a unitary structure, as shown, or it may be comprised of a number of discrete parts or segments, for example. The blocking body 36 generally includes the attachment area 38 located at one end of the cylinder, the projecting end 40 located at the other end of the cylinder, defining a blocking surface 42 therebetween. Additionally, the blocking body 36 may include one or more covers or coatings (not shown) along all of the blocking surface 42 or a part of the blocking surface 42, which may serve a decorative purpose or may provide more cushioning, to cite a few examples. As will be discussed in further detail below, the blocking body 36 and the blocking surface 42 are dimensioned so as to block shot attempts that are at an undesirable shooting angle or will result in an undesirable bank angle.

Figure 2:
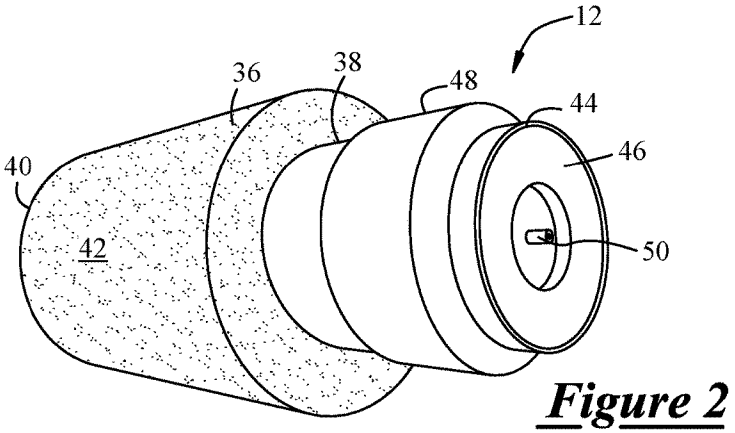
FIG. 2 shows an attachment end of the basketball training device of FIG. 1.
Figure 3:
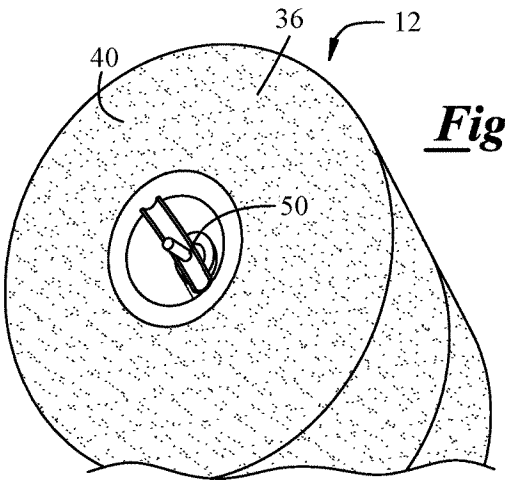
FIG. 3 shows a projecting end of the basketball training device of FIGS. 1 and 2.

FIG. 2 shows an enlarged view of the attachment area 38 of the blocking body 36 which includes a basketball hoop attachment mechanism 44. The basketball hoop attachment mechanism 44 may be any suitable component for mounting the basketball training device 12 to the basketball hoop 10. For example, the basketball hoop attachment mechanism 44 may include one or more magnets, clips, clamps, brackets, suction devices, etc., to name a few possibilities. In the embodiment illustrated in FIG. 2, the basketball hoop attachment mechanism 44 includes a magnet 46, and more particularly, a 95-100 pound magnet, which can help withstand the various forces incurred upon impact during practice. One or more spacers 48 may be included to improve the spacing of the blocking body 36 relative to the rim 14 and/or the backboard 16. The basketball hoop attachment mechanism 44 may be coupled to the attachment area 38 of the blocking body 36 in any operable fashion. In this embodiment, a dowel or rod 50 which extends the length of the blocking body 36 from the attachment area 38 to the projecting end 40, as shown in FIG. 3, is included to couple the basketball hoop attachment mechanism 44 to the blocking body. Other coupling means are certainly possible. For example, the blocking body 36 and the basketball hoop attachment mechanism 44 may be directly integrated with the basketball hoop 10. Additionally, the attachment area 38 may not necessarily be at the end of the blocking body 36 opposing the projecting end 40. For example, the attachment area may be more centrally located along the blocking body to mount the blocking body to the bottom edge 24 of the backboard 16. In the illustrated embodiment, however, the attachment area 38 is located at an end of the blocking body 36 to allow for the basketball hoop attachment mechanism 44 to attach to the rim 14, and more particularly, to the triangular sidewall 22 of the rim support 20. Any number of mounting configurations and types are very well possible, however.

Figure 4:
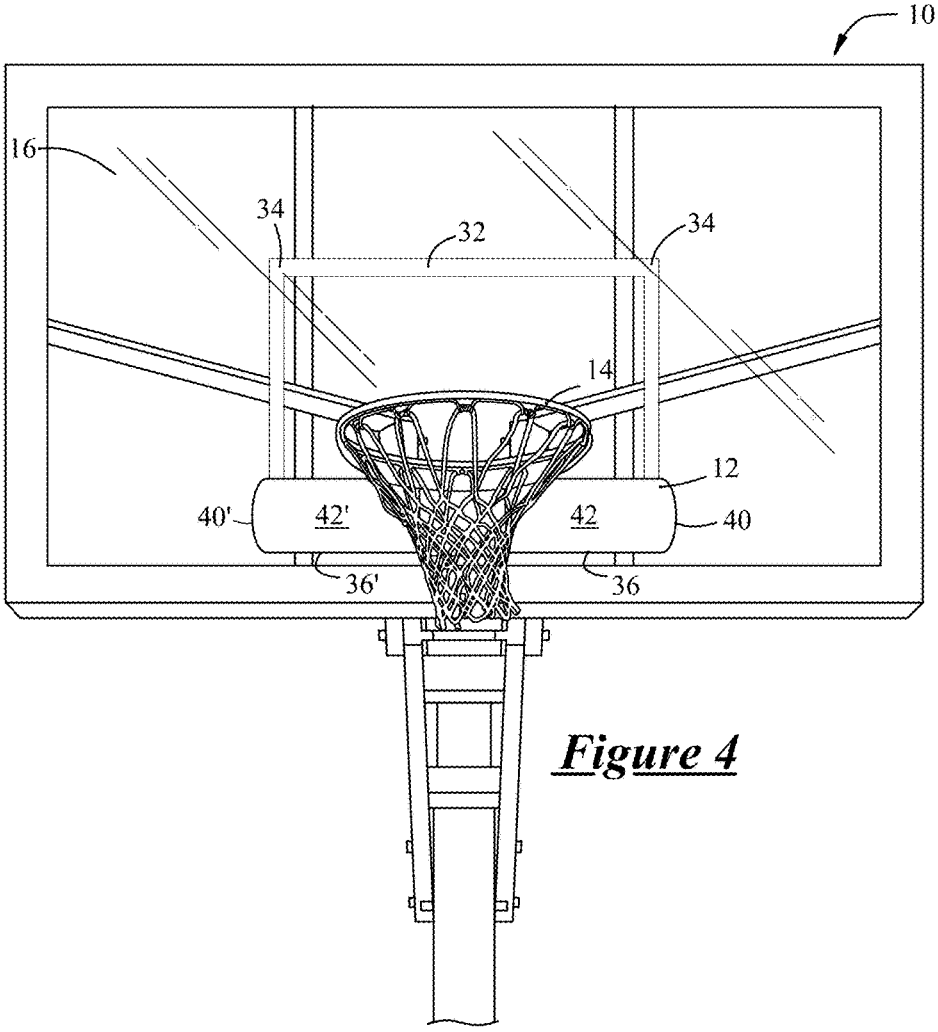
FIG. 4 shows a basketball hoop including a basketball training device in accordance with another embodiment.
Figure 5:
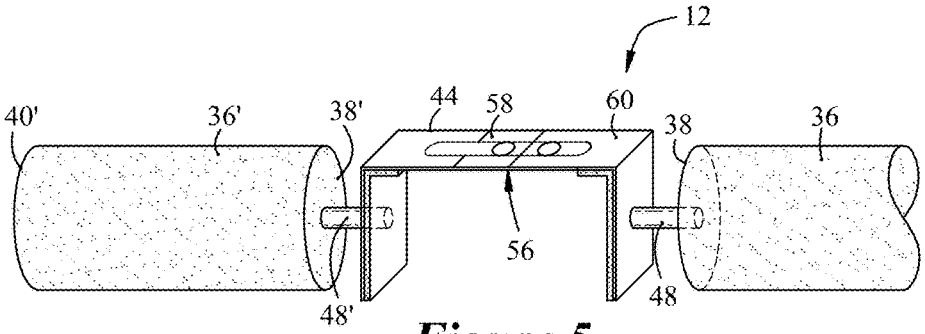
FIG. 5 shows one embodiment of the basketball training device shown in FIG. 4.

FIGS. 4 and 5 show another embodiment of a basketball training device 12. In this embodiment, the basketball training device 12 includes two blocking bodies, 36, 36'. This particular embodiment is advantageous in that it can simultaneously provide for right or left handed practice while relying upon only a single basketball hoop attachment mechanism. Each blocking body 36, 36' includes an attachment area 38, 38' and a projecting end 40, 40', with the projecting ends 40, 40' opposing each other on either side of the basketball training device 12 (some reference numerals have been omitted from FIG. 4 for clarity purposes) and the attachment areas 38, 38' facing each other. However, other configurations are certainly possible, and it is not necessary for the blocking bodies 36, 36' to mirror each other as shown, but it is preferred. This embodiment of the basketball hoop attachment mechanism 44 comprises a bracket. A single bracket with two connection portions which couple the bracket to the attachment areas of the blocking bodies 36, 36'. The connection portions are located on either side of a planar support portion 56 which helps to support the basketball training device 12 relative to the basketball hoop 10. In this embodiment, the support portion 56 rests along the back of the rim 14 adjacent to the backboard 16 such that the blocking bodies 36, 36' extend along either side of the rim 14 along the backboard 16.

As shown in FIG. 5 in particular, instead of a single bracket, the basketball training device 12 can include a plurality of slotted brackets 58, 60. The slotted brackets 58, 60 allow for the basketball hoop attachment mechanism 44 to be adjustable in length and adaptable to different dimensions of the rim 14 and/or adaptable to different spacing of the blocking bodies 36, 36' relative to each other. Additionally, with respect to any embodiment, all of the basketball hoop attachment mechanism 44, or one or more portions of the basketball hoop attachment mechanism 44 may be coated or lined with a foam material, a rubber material, or another elastic based material. The FIG. 5 embodiment also shows the inclusion of spacers 48, 48' in the form of plastic dowels that may be used to help couple the basketball hoop attachment mechanism to a respective blocking body 36, 36'.

The dimensions for the various components of the basketball training device 12 can vary depending on the desired implementation. For example, the length of each blocking body 36, 36' is preferably 12 inches, as shown, but it may be shorter or longer depending on the desired implementation. In another example, the blocking body length may measure to the edge of the shooter's square 32, or it may extend out to the side edge 28 of the backboard 16 or end anywhere in between. If a cylinder shape is used for the blocking body 36, the cylinder may have a diameter between 4 and 8 inches, with a 6 inch diameter being preferred. However, it should be understood that these dimensions are merely examples, and other dimensions, shapes, configurations, etc. are certainly possible.

Figure 6A:
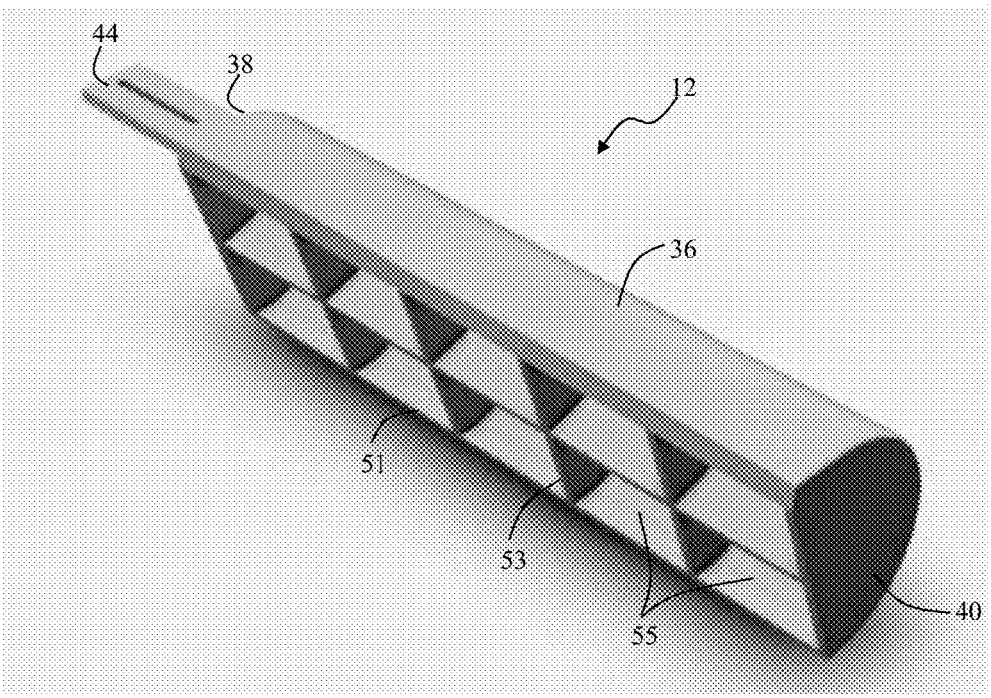
FIGS. 6A and 6B illustrate another embodiment of the basketball training device.
Figure 6B:
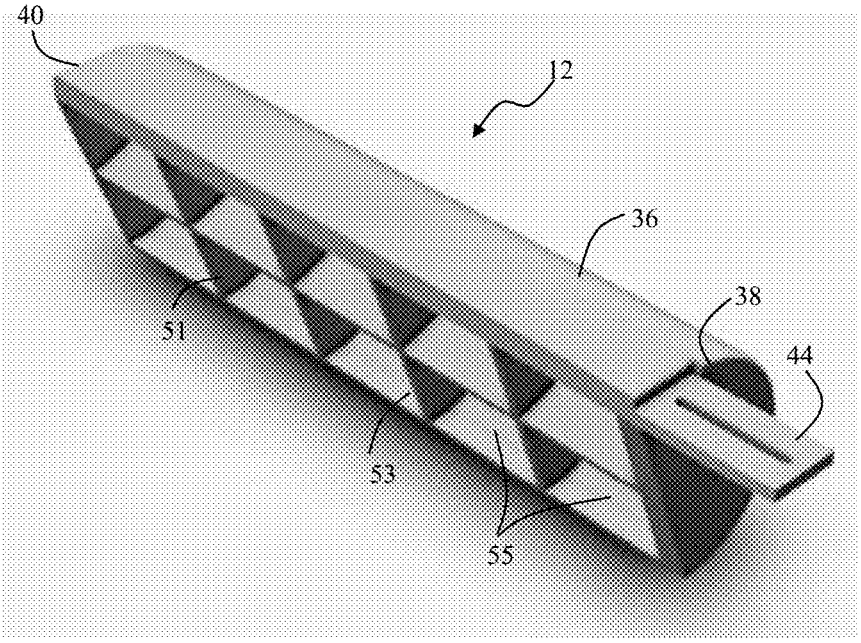

FIGS. 6A and 6B show another embodiment of the basketball training device 12. FIGS. 6A and 6B are mirror images of each other which can come together at the attachment mechanism 44 or bracket to accommodate any size rim. In this embodiment, the blocking body 36 and the attachment mechanism 44 are an integral piece, which may be made out of plastic or any other operable material. The blocking body 36 has a backboard facing side 51 and a structural support 53 which defines a number of recesses 55 (only two are labeled in FIGS. 6A and 6B for clarity purposes). The blocking body 36 in this embodiment is a semi-cylinder or a half cylinder. Instead of having a solid structure for the blocking body, including one or more recesses 55 may reduce the weight of the basketball training device 12 which may provide for easier installation and removal, to cite just one possible advantage. This embodiment of the basketball training device 12 may be attached to another blocking body as shown with previous embodiments via the attachment mechanism 44.

FIG. 7 schematically represents various shooting angles that may be blocked by one embodiment of the basketball training device 12. It should be noted that the drawing is for illustration purposes only, and is not necessarily to scale. In the schematic representation, the blocking body 36 of the basketball training device 12 is a cylinder with a 6 inch diameter. However, skilled artisans will appreciate that the angle calculations may be adapted for different shapes and diameters and/or device heights. Additionally, the shooting angle will be a function of distance from the backboard 16 and release height $H_{release}$. Accordingly, the shooting angle may be defined in different ways, one being variable depending on a given release height $H_{release}$ and one being variable depending on a given horizontal release distance X from the backboard 16. Furthermore, the shooting angle calculations use a rim height $H_{rim}$ of 10 feet with the blocking body 36 extending 2 inches above the rim 14 and 4 inches below the rim. The shooting angle calculations also use a basketball with a diameter of 9.5 inches and a straight trajectory in order to make the calculations more adaptable and reproducible. As addressed above, skilled artisans can vary the shooting angle calculations depending on the mounting location of the rim 14 and the blocking body 36. The blocked shooting angles disclosed herein are meant to provide a quantitative estimate of preferred blocking body structures that may help provide players with improved layup shooting accuracy. Other forms of quantitative estimation are certainly possible.

FIG. 7 schematically illustrates two angles, $\theta_1$ and $\theta_2$, that may be used to provide a quantitative estimate of blocking angles given the considerations outlined above. In this example, angles between $\theta_1$ and $\theta_2$ would be blocked by the blocking body 36, and angles greater than $\theta_2$ would be preferred, particularly in view of the fact that the basketball training device 12 would help encourage shots with a larger shooting angle such that the ball hits the backboard 16 on its downward trajectory instead of banking the ball from below. The measurements relative to the backboard include $H_{device}$ of 9.6667 feet for $\theta_1$, which assumes that the blocking body extends 4 inches below the rim 14 which is 10 feet above the ground, and $H_{device+ball}$ of 10.5625 feet for $\theta_2$, which assumes that the ball diameter is 9.5 inches and allows for clearance of the ball above the blocking body which has a 6 inch diameter. As described above and detailed below, these measurements can be used to calculate the length of the opposite side of the right triangle used to define each respective angle, and is variable depending upon the release height $H_{release}$. Again, FIG. 7 is not drawn to scale, but is included for example purposes to illustrate the quantitative estimate of preferred blocking body structures.

Assuming a release height $H_{release}$ of about 7 feet, the measurements relative to the backboard described above, and a horizontal release distance X of about 3 feet, the inverse tangent may be used to determine that the blocked shooting angles (between $\theta_1$ and $\theta_2$) are between about 41° and 50° (inclusively rounded to the nearest degree). Again, assuming a release height $H_{release}$ of about 7 feet, the measurements relative to the backboard described above, and a horizontal release distance X of about 6 feet, the inverse tangent may be used to determine that the blocked shooting angles (between $\theta_1$ and $\theta_2$) are between about 23° and 31° (inclusively rounded to the nearest degree). At distances further from the basketball hoop 10, a lower shooting angle is needed to surmount the blocking body 36. Accordingly, the basketball training device 12 can encourage players to release the ball sooner and at a better angle to improve the accuracy of their layup shots. Further, assuming a horizontal release distance X of about 4.5 feet, a release height $H_{release}$ of about 6 feet, and the measurements relative to the backboard described above, the inverse tangent may be used to determine that the blocked shooting angles (between $\theta_1$ and $\theta_2$) are between about 39° and 44° (inclusively rounded to the nearest degree). Lastly, to provide another example, assuming a horizontal release distance X of about 4.5 feet, a release height $H_{release}$ of about 8 feet, and the measurements relative to the backboard described above, the inverse tangent may be used to determine that the blocked shooting angles (between $\theta_1$ and $\theta_2$) are between about 20° and 30° (inclusively rounded to the nearest degree). Thus, if a player is taller or can jump higher, a lower shooting angle may be required to overcome the blocking body 36. The basketball training device 12 can accordingly assist in the development of higher shooting accuracy for a range of horizontal release distances and release heights.

FIGS. 8 and 9 show embodiments of a placement apparatus 62 that may be used for grabbing and placing the basketball training device 12. In one embodiment, a kit includes both the basketball training device 12 and the placement apparatus 62. The placement apparatus 62 may include an extended handle 64 and a grabbing mechanism 66 for grabbing and placing the basketball training device 12 onto the basketball hoop 10. FIG. 9 shows another embodiment of a placement apparatus 62 that also includes another practice blocker 68. The extended handle 64 may be a straight, curved, or other shaped handle, and it may be telescopic or have other extendable/collapsible aspects. The grabbing mechanism 66 is in the form of a metal hook which may be coated in some embodiments, or it may take other forms so long as it is operable to place the basketball training device 12 in a desired location and/or orientation.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A basketball training device for mounting onto a basketball hoop having a rim and a backboard, the basketball training device comprising:

a first blocking body;

a second blocking body; and a basketball hoop attachment mechanism coupled to the first blocking body and the second blocking body, wherein the basketball hoop attachment mechanism is configured to mount the blocking body on the rim of the basketball hoop, wherein the basketball hoop attachment mechanism that couples the first blocking body and the second blocking body includes one or more brackets and has an adjustable length.

2. The basketball training device of claim 1, wherein the basketball hoop attachment mechanism includes a plurality of slotted brackets.

3. The basketball training device of claim 1, wherein at least one blocking body is a cylinder, a half cylinder, or a semi-cylinder.

4. The basketball training device of claim 1, wherein at least one blocking body has a blocking surface, and the at least one blocking body and the blocking surface are dimensioned so as to block a shooting angle.

5. The basketball training device of claim 4, wherein the at least one blocking body is configured to block shooting angles between 41° and 50°, inclusive, given a release height of about 7 feet of a ball from ground-level and a horizontal release distance of about 3 feet of the ball from the backboard.

6. The basketball training device of claim 4, wherein the at least one blocking body is configured to block shooting angles between 23° and 31°, inclusive, given a release height of about 7 feet of a ball from ground-level and a horizontal release distance of about 6 feet of the ball from the backboard.

7. The basketball training device of claim 4, wherein the at least one blocking body is configured to block shooting angles between 39° and 44°, inclusive, given a release height of about 6 feet of a ball from ground-level and a horizontal release distance of about 4.5 feet of the ball from the backboard.

8. The basketball training device of claim 4, wherein the at least one blocking body is configured to block shooting angles between 20° and 30°, inclusive, given a release height of about 8 feet of a ball from ground-level and a horizontal release distance of about 4.5 feet of the ball from the backboard.

9. A kit for basketball training comprising:

the basketball training device of claim 1; and a placement apparatus having an extended handle and a grabbing mechanism for grabbing and placing the basketball training device.

10. A basketball hoop comprising the basketball training device of claim 1.

11. A basketball training device for mounting onto a basketball hoop having a rim, a rim support, and a backboard, the basketball training device comprising:

a basketball hoop attachment mechanism configured to removably rest on a top of the rim support; and a plurality of blocking bodies, each blocking body including an attachment area and a projecting end, wherein a first blocking body is configured to be located on one side of the rim and a second blocking body is configured to be located on another side of the rim, wherein the attachment area of the first blocking body faces the attachment area of the second blocking body and the projecting end of the first blocking body opposes the projecting end of the second blocking body, wherein the basketball hoop attachment mechanism is attached to the first blocking body at the attachment area of the first blocking body and the basketball hoop attachment mechanism is attached to the second blocking body at the attachment area of the second blocking body.

12. The basketball training device of claim 11, wherein the first blocking body and the second blocking body mirror each other across the basketball hoop attachment mechanism.

13. A basketball training device for mounting onto a basketball hoop having a rim and a backboard, the basketball training device comprising:

a blocking body, wherein the blocking body is a cylinder, a half cylinder, or a semi-cylinder having one or more recesses on an interior of the cylinder, the half cylinder, or the semi-cylinder; and a basketball hoop attachment mechanism coupled to the blocking body, wherein the basketball hoop attachment mechanism is configured to mount the blocking body on the rim or the backboard of the basketball hoop.

* * * * *